US006955176B2

(12) United States Patent
Ackermans et al.

(10) Patent No.: US 6,955,176 B2
(45) Date of Patent: Oct. 18, 2005

(54) DEVICE AND METHOD FOR APPLYING HAIR DYE TO HAIR

(75) Inventors: Paul Anton Josef Ackermans, Eindhoven (NL); Saskia Alois Catharina Hanneman, Eindhoven (NL); Fred Fraij, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 369 days.

(21) Appl. No.: 10/274,212

(22) Filed: Oct. 18, 2002

(65) Prior Publication Data

US 2003/0075194 A1 Apr. 24, 2003

(30) Foreign Application Priority Data

Oct. 23, 2001 (EP) ..... 01204018

(51) Int. Cl.[7] ..... A45D 24/22; A45D 24/10; A45D 1/00

(52) U.S. Cl. ..... 132/112; 132/118; 132/271; 132/269

(58) Field of Search ..... 132/112, 116, 132/271

(56) References Cited

U.S. PATENT DOCUMENTS

| | | | | | |
|---|---|---|---|---|---|
| 1,693,248 | A | | 11/1928 | Newton | |
| 4,121,602 | A | | 10/1978 | Young | 132/113 |
| 4,376,441 | A | * | 3/1983 | Duncan | 132/272 |
| 4,913,172 | A | * | 4/1990 | Chou | 132/118 |
| 5,136,850 | A | * | 8/1992 | Bierschenk et al. | 62/3.62 |

FOREIGN PATENT DOCUMENTS

| | | | |
|---|---|---|---|
| DE | 4326223 A1 | 2/1995 | A45D/19/16 |
| DE | 10012415 A | 9/2001 | A45D/19/00 |
| WO | WO0027240 | 5/2000 | A45D/24/22 |

* cited by examiner

*Primary Examiner*—John J. Wilson
*Assistant Examiner*—Robyn Doan

(57) ABSTRACT

A device and a method for applying hair dye to hair. The device comprises a housing, a reservoir for said hair dye, at least one opening for said hair dye to pass through, and means for moving the hair dye from said reservoir to the hair via said at least one opening for the hair dye, wherein first heating means are provided for heating the hair dye before said hair dye passes through said at least one opening for the hair dye. The method comprises the heating of the hair dye prior to the application of the hair dye to the hair.

9 Claims, 1 Drawing Sheet

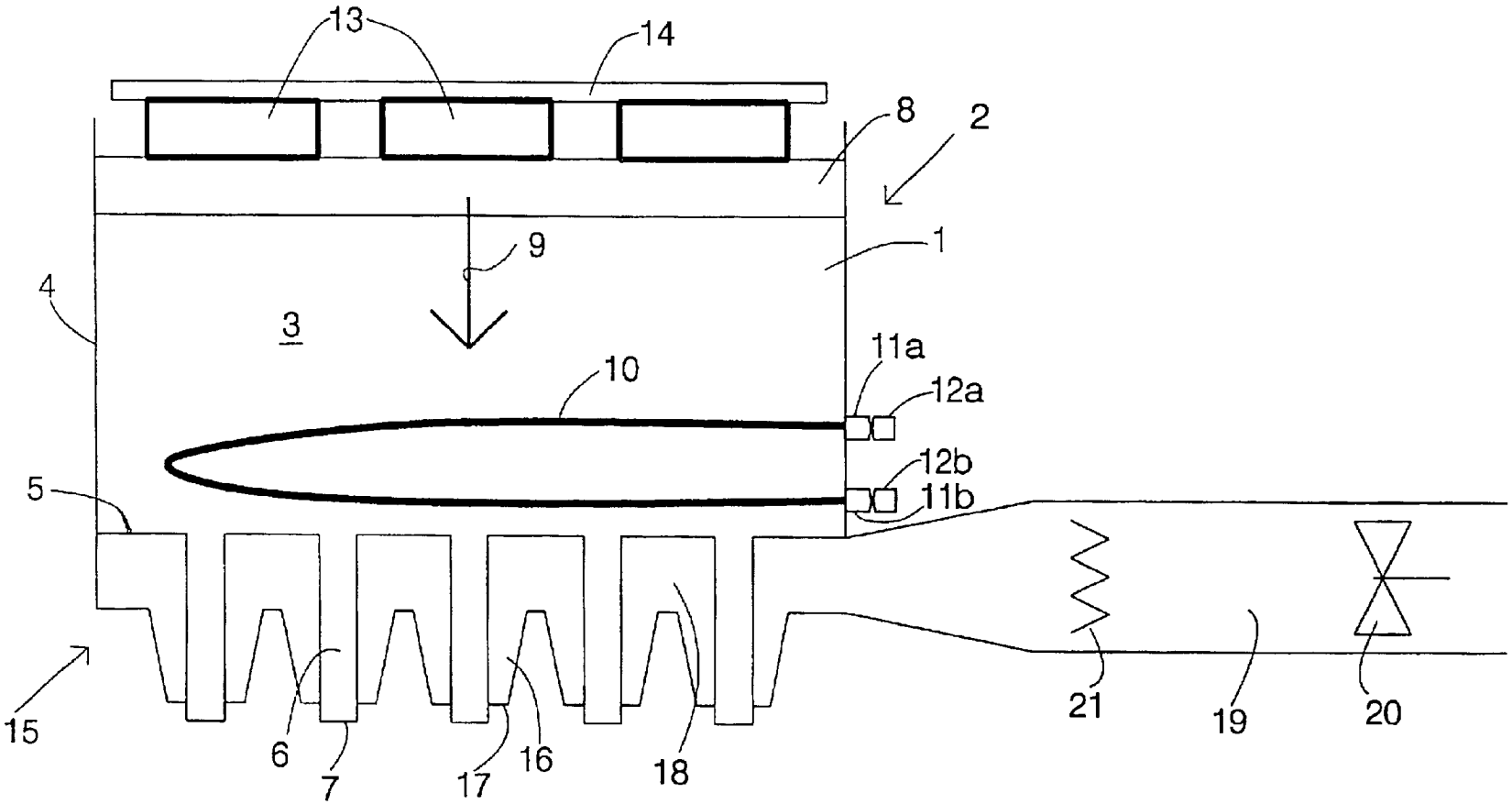
2
8
1
11a
12a
12b
11b
20
19
21
14
13
9
10
3
18
16
17
7
6
4
5
15

DEVICE AND METHOD FOR APPLYING HAIR DYE TO HAIR

The invention relates to a device for applying hair dye to hair, comprising a housing, a reservoir for said hair dye, at least one opening for said hair dye to pass through, and means for moving the hair dye from said reservoir to the hair via said at least one opening for the hair dye.

A device of the above type is known from international patent application WO 00/27240 A1. Said publication discloses a device comprising a housing which is capable of accommodating a disposable cartridge for hair dye. Said cartridge is provided with openings at one side, which openings are located at the ends of regularly spaced, projecting parts which can be moved through the hair. At the opposite side, the disposable cartridge is provided with a plunger-like element which can be moved in the direction of the openings by means of a pusher element forming part of the device, thereby forming a liquid-tight seal against the longitudinal walls of the cartridge. As a result, the dye is displaced within the disposable cartridge in the direction of the openings, so that the hair dye will exit the cartridge and be applied to the hair of the user of the device. Such a device makes it possible to apply the hair dye to the hair in a very uniform manner, as a result of which the hair will be dyed evenly.

The object of the invention is to provide a device as described in the opening paragraph which makes it possible to accelerate the dyeing process, so that the dyeing of the user's hair will take less time. In order to accomplish that objective, the device comprises first heating means for heating the hair dye before said hair dye passes through said at least one opening for the hair dye. Experiments have shown that the rate of absorption of the hair dye by hair, and thus the speed at which the dyeing process takes place, can be considerably increased if the hair dye is heated prior to being applied to the hair. If the hair dye has a temperature of 35° C. upon being applied to the hair, the rate of absorption is found to be considerably higher than in the situation wherein the hair dye is not heated in advance.

A constructionally simple embodiment of the device according to the invention can be obtained if the first heating means are disposed along at least part of the outer circumference of the reservoir. The transfer of heat between the first heating means and the hair dye can take place through heat conduction through the wall of the reservoir in that case. In the embodiment as disclosed in the aforesaid international patent application WO 00/27240 A1, it would be possible to consider heating elements that are present at the side of the plunger-like element remote from the openings, as a result of which said plunger-like element will heat up, in turn heating the hair dye that is present in the cartridge.

Alternatively, said first heating means may comprise at least one electrical heating element which is present inside the reservoir. This makes for a very efficient heating process, because all the heat that is being emitted by said at least one heating element is given off to its direct surroundings, in this case the hair dye.

Another possibility for the embodiment of the first heating means is obtained if said first heating means comprise air heating means, and the device comprises air displacement means for moving heated air past the reservoir for the purpose of effecting a heat exchange between the heated air and the hair dye in the reservoir. The advantage of such an embodiment is that the heat source, such as an incandescent filament, for example, or a gas cartridge whose contents are suitable for catalytic combustion, does not necessarily have to be positioned directly adjacent the reservoir.

In order to accelerate the hair dyeing process further, a very advantageous embodiment of the device according to the invention comprises second heating means for heating the hair dye after the hair dye has passed through said at least one opening for the hair dye. Said second heating means make it possible to maintain the optimum temperature for accelerating the dyeing process as long as possible, and hair dye will not cool down immediately after being applied to the hair.

If the first heating means comprise air heating means, and the device comprises air displacement means, a very advantageous embodiment of the device is obtained if said first heating means and said second heating means are at least partially constructed as one unit, and if at least one opening for the passage of the heated air to the hair is provided. With such a device, the heated air serves both to heat the hair dye or maintain the temperature thereof before the hair dye is applied to the hair and to keep the hair dye at the correct temperature after it has been applied to the hair.

A very advantageous embodiment from an energy viewpoint is obtained if said at least one air opening or said at least one opening for the hair dye surrounds the other one of said at least one air opening or said at least one opening for the hair dye. As a result of this arrangement, heating of the hair dye takes place until the moment just before the hair dye exits the opening for the hair dye, and also thereafter.

Alternatively, said second heating means may comprise an infrared heating source and/or steam generating means, for example. This may further improve the quality of the dyeing process.

According to another advantageous embodiment, the reservoir is made up of a disposable cartridge that can be connected to the housing, so that the user is not confronted with the time-consuming need to fill the reservoir with hair dye, with the attendant risk of hair dye being spilled. It is conceivable here for the disposable cartridge to be provided with electrical contact terminals through which power can be supplied to an electrical heating element which is present within the disposable cartridge.

The invention furthermore relates to a method of applying hair dye to hair. The object of the method according to the invention fits in with that of the device according to the invention as described above, that is, accelerating the dyeing process. In order to accomplish that objective, the method according to the invention is characterized in that the hair dye is heated prior to the application thereof.

It has become apparent that, from the viewpoint of safety and comfort on the one hand and the desire to achieve the quickest possible absorption of the hair dye by the hair on the other hand, an optimum temperature of the hair dye prior to being applied to the hair lies between 25° C. and 45° C.

The invention will now be explained in more detail by means of a description of a preferred embodiment of the device according to the invention, which is also suitable for carrying out the method according to the invention. The FIGURE schematically shows a model of the preferred embodiment.

Present in the interior 1 of a disposable reservoir 2 is a liquid hair dye 3. The disposable reservoir 2 is laterally formed by a cylindrical wall 4. Hollow, outwardly extending teeth 6 are formed in the bottom surface 5 of the disposable reservoir 2, with passages 7 being present in the ends of said teeth. Via said passages 7, the liquid hair dye 3 can be applied to a person's hair. To this end, the disposable reservoir 2 comprises a plunger cover 8, which is movable in the direction indicated by arrow 9 under the influence of an external force, during which movement a seal is maintained, at least for liquid hair dye 3, between the edges of the plunger cover 8 and the inner side of the cylindrical wall 4. A concrete embodiment of the above-described model is included in international patent application WO 00/27240 A1. The disposable reservoir 2 is accommodated in a housing (not shown) of a device by means of which a person can apply hair to his or her own hair. Said device comprises, amongst other parts, the means for moving the plunger cover 8 in the direction indicated by arrow 9. Present in the interior 1 of the disposable reservoir 2 is an electrical resistance wire 10 capable of giving off heat to its surroundings when an electrical current is being passed therethrough, thus heating the liquid hair dye 3. Two electrical contact terminals 11*a*, 11*b* are present at respective ends of the electrical resistance wire 10, on the outer side of cylindrical wall 4, which contact terminals form part of the disposable reservoir 2. If the disposable reservoir 2 is correctly positioned in the housing of the device, the electrical contact terminals 11*a*, 11*b* are in electrically conductive contact with electrical contact terminals 12*a*, 12*b*, respectively, which form part of the device and which can be connected to a suitable power source. Thus the hair dye 3 present in the interior of the disposable reservoir 2 can be heated by the electrical resistance wire 10, for example to a temperature of 35° C . By moving the plunger cover 8 downwards, pre-heated liquid hair dye 3 can thus be applied to the hair via the passages 7.

Alternatively, or in combination with the use of the electrical resistance wire 10, suitable electrical resistance-type heating elements 13, in which an electrical resistance element having a positive temperature coefficient is used, may be present on the plunger cover 8. Said heating elements 13 preferably form part of the device. In the illustrated situation, a common press-down plate 14 is provided, to the bottom side of which the heating elements 13 are connected, via which heating elements 13 the plunger cover 8 is pressed down. The heat that is emitted by the heating elements 13 first heats the plunger cover 8, as a result of which the liquid hair dye 3 present in the interior 1 of disposable reservoir 2 is heated.

Optionally, a nozzle 15 is present at the lower side of the disposable reservoir 2, which nozzle comprises conical mouths disposed between respective teeth 6, at the end of which respective outlet openings 17 are present. The nozzle 15 forms part of the housing of the device. The disposable reservoir 2 and the nozzle 15 are arranged with respect to each other such that the teeth 6 extend centrally within the associated mouth 16. The interior 18 of the nozzle 15 is connected to an air line 19 in which a fan 20 and, downstream of said fan 20, a spiral filament 21 are present. The fan 20 draws in air from outside the device and moves said air, via the spiral filament 21 to the nozzle 15, where the air, which has in the meantime been heated by the spiral filament 21, exits the nozzle 15 via the outflow openings 17. The heated air ensures that the liquid hair dye 3, insofar said hair dye is present in between the teeth 6, is heated to the correct temperature or maintained at said temperature if additional heating elements such as a resistance wire 10 or heating elements 13 are used, which, however, is not strictly necessary for that matter. In addition to this, the heated air is blown onto the hair, as a result of which the liquid hair dye 3 also remains heated after it has been applied to the hair, so that the hair dyeing process can take place at an accelerated rate. In addition to that, the heated air heats up, or helps to heat up, the liquid hair dye 3 present in the interior 1 of the disposable reservoir 2.

What is claimed is:

1. A device for applying hair dye to hair, comprising:

a housing, a reservoir for said hair dye, at least one opening for said hair dye to pass through, means for moving the hair dye from said reservoir to the hair via said at least one opening for the hair dye, first heating means for heating the hair dye before said hair dye passes through said at least one opening for the hair dye, and second heating means for heating the hair dye after the hair dye has passed through said at least one opening for the hair dye.

2. A device as claimed in claim 1, wherein the first heating means are disposed along at least part of the outer circumference of the reservoir.

3. A device as claimed in claim 1, wherein said first heating means comprise at least one electrical heating element which is present inside the reservoir.

4. A device as claimed in claim 1, wherein said first heating means comprise air heating means, and the device comprises air displacement means for moving heated air past the reservoir for the purpose of effecting a heat exchange between the heated air and the hair dye in the reservoir.

5. A device as claimed in claim 1, wherein said second heating means comprise an infrared heating source.

6. A device as claimed in claim 1, wherein said second heating means comprise steam-generating means.

7. A device as claimed in claim 1, wherein said reservoir is formed of a disposable cartridge which can be connected to the housing.

8. A device for applying hair dye to hair, comprising:

a housing, a reservoir for said hair dye, at least one opening for said hair dye to pass through, means for moving the hair dye from said reservoir to the hair via said at least one opening for the hair dye, first heating means for heating the hair dye before said hair dye passes through said at least one opening for the hair dye, second heating means for heating the hair dye after the hair dye has passed through said at least one opening for the hair dye, wherein said first heating means comprises air heating means, the device comprising air displacement means for moving heated air past the reservoir for the purpose of effecting a heat exchange between the heated air and the hair dye in the reservoir; and wherein said first heating means and said second heating means are at least partially constructed as one unit, and at least one opening for the passage of the heated air to the hair is provided.

9. A device as claimed in claim 8, wherein said at least one air opening or said at least one opening for the hair dye surrounds the other one of said at least one air opening or said at least one opening for the hair dye.

* * * * *